US005193425A

United States Patent [19]

Campbell, Jr. et al.

[11] Patent Number: 5,193,425

[45] Date of Patent: Mar. 16, 1993

[54] CHIP IMPALEMENT SPEARS FOR ROTARY CUTTERS

[75] Inventors: Gaines P. Campbell, Jr., Lookout Mountain; Blaine C. Stambaugh, Signal Mountain, both of Tenn.

[73] Assignee: NWF Industries, Chattanooga, Tenn.

[21] Appl. No.: 699,705

[22] Filed: May 14, 1991

[51] Int. Cl.[5] ..... B26D 7/18

[52] U.S. Cl. ..... 83/113; 83/115; 83/154; 493/342; 493/373

[58] Field of Search ..... 83/154, 151, 161, 302, 83/423, 27, 113, 115, 116, 117; 493/342, 472, 373; 225/99

[56] References Cited

U.S. PATENT DOCUMENTS

| | | | |
|---|---|---|---|
| 2,327,952 | 8/1943 | Zimmerman | 493/342 |
| 2,677,994 | 5/1954 | Schneider | 493/373 |
| 3,215,049 | 11/1965 | Meylan et al. | 493/373 |
| 4,224,851 | 9/1980 | Imai | 83/113 |
| 4,295,842 | 10/1981 | Bell | 83/161 |
| 4,640,165 | 2/1987 | McMahon et al. | 83/346 |
| 4,846,030 | 7/1989 | McMahon et al. | 83/154 |

*Primary Examiner*—Frank T. Yost
*Assistant Examiner*—Allan M. Schrock
*Attorney, Agent, or Firm*—Phillips & Beumer

[57] ABSTRACT

Chip-impalement spears for rotary cutters are provided in a rectangular shape with a single sharp bevelled edge along the top of the spears and adapted to be placed parallel to a roller of the rotary cutter. The spears are embedded in one roller and arranged so that their sharp edges will come into slight contact with an opposing roller. Properties of the spears, in particular, hardness, are selected to enable the spears to be rapidly bent over in use, forming a chip-retaining barb. Spears having this capability may be obtained by making transverse cuts across a cutting rule.

9 Claims, 2 Drawing Sheets

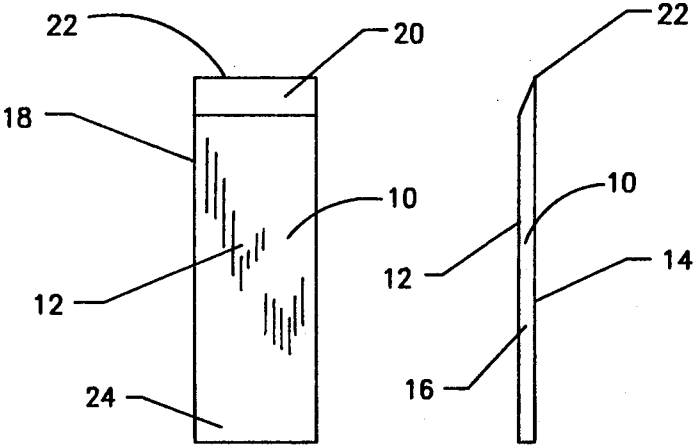
FIG. 1
FIG. 2
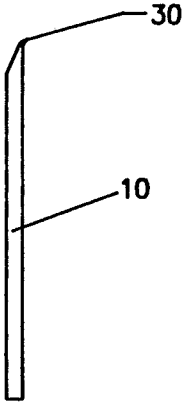
FIG. 4
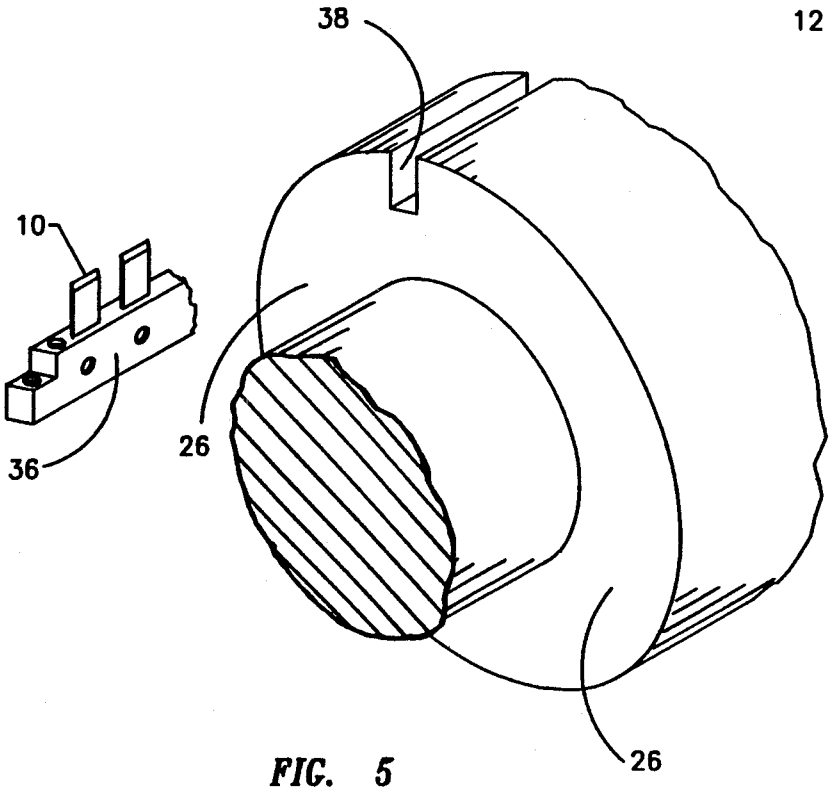
FIG. 5

CHIP IMPALEMENT SPEARS FOR ROTARY CUTTERS

FIELD OF THE INVENTION

This invention relates generally to web printing press equipment and more particularly to apparatus for removing and disposing of scrap chips produced by rotary cutting of a web-printed product.

BACKGROUND OF THE INVENTION

Rotary cutters using cooperating rollers for performing transverse cuts on a web of printed paper product are widely used in the printing industry. Such devices typically have longitudinally extending knives protruding out from the surface of one or both of the cooperating rollers, with at least one of the rollers serving as an anvil spaced apart so as to be slightly contacted by the opposing knife roller. The circumference of the cutting roller is normally a fixed dimension longer than the multiple repeat length of the product material being cut and not an exact multiple thereof so that a pair of transverse cuts may be required between adjacent units. This results in production of transverse strips or "chips" of material, which must be removed from the cutting area and disposed of in order to avoid interference with delivery of the finished units or products.

Use of impalement pins for grasping chips and removing them from the cutting are of a rotary cutter is disclosed in several prior art patents. U.S. Pat. No. 3,893,359, issued Jul. 5, 1975, to Gregoire, discloses placement of sharpened pins on an anvil roller that cooperates within an opposing cutting roller, the pins impaling transversely cut chips at the cutting area between rollers and conveying them around and away from the cutting area where they are removed from impalement by coming into contact with stripping fingers adjacent to the back side of the anvil roller. U.S. Pat. No. 4,846,030, issued Jul. 11, 1989, to McMahon et al., discloses mounting of impalement pins on a disc which brings the pins into engagement with chips as they are cut. The impaled chips are removed from the pins by being contacted with an abuttment member such as a moving belt. U.S. Pat. No. 4,691,603, issued Sep. 8, 1987, to Winnemoller, discloses extensible needles for piercing material that is to be removed by a cutter, the needles being serrated for providing frictional grasping engagement. None of these references discloses a specific shape for the pins or needles except that they are pointed and in one case provided with serrations.

Impalement pins as employed in prior art devices exemplified by the referenced patents have relied upon relatively deep impalement to secure chips for removal away from the cutting area, the pins typically being arranged to stab the chips to a depth of ⅛ inch. While providing for effective grasping of the chips, this makes for difficulty in removing them from the pins. In the case of devices using a mechanical comb-like stripper with fingers placed between the cylinder and the chip, linear placement and spacing are very critical, and jamming occurs frequently. Another approach is to use a rotating wheel onto which are mounted pins that are moving both faster than and timed to the chip. The pins on the wheel stab the chip and rip it loose from the pins on the roller. This requires perfect timing and further apparatus to strip the chips from the wheel. The pins tend to break and to be ineffective in transferring the chips from the roller to the stripper wheel. A still further method uses pins that are mounted in the cylinder so as to be retractable to release the chip. While providing for effective release of chips, the required retraction mechanism is expensive and difficult to manufacture.

Rectangular-shaped spears obtained by cutting off a transverse section of a perforation rule are used instead of round pins in rotary cutters made by Baldwin Technology. These spears at their chip-engagement end have a double-bevelled sharp edge parallel to and spaced apart halfway between edges of side faces of the spear. Spears with this geometry at their chip-impalement ends do not form a bent-over barb that would retain chips, but rather become slightly flattened out upon contacting the surface of an opposing roller. Retention of chips is provided for by deep penetration as described above.

It is desired to provide chip-impalement spears that may be arranged to grip chips lightly but effectively facilitating controlled removal of the chips and avoiding problems associated with prior art approaches.

SUMMARY OF THE INVENTION

The present invention is directed to a chip-impalement spear for a rotary cutter such as may be used for cutting of product units produced by a web printing process and which generates scrap pieces in the form of transversely extending chips. Rotary cutters for which the spears embodying the invention are useful have cooperating rollers including a knife roller with knives protruding from the roller surface and extending along its length and an anvil roller placed parallel to the knife roller and spaced apart from the knife roller a distance such that the knives come into contact with the anvil roller. Spears for impalement of chips are mounted on one of the rollers and are arranged to pierce the chips as they are cut and to convey the chips away from the cutting area.

Chip-impalement spears of the present invention have a generally rectangular shape with a single beveled outer end extending diagonally inward from a sharp edge defined along the length of the end of a side face of the spear. The spears are adapted to be placed with the sharp edge on the forward side with respect to roller movement so that the sharp edge will come into slight contact with the opposing roller upon impaling a chip. Such contact causes the edge to be bent over at the tip of the spear, forming a one-sided barb that retains the chip until it is conveyed away from the cutting area before being stripped and removed for disposal. Material from which the spear is made and its tempering or other processing history is selected to provide a hardness value that enables formation of a suitable barb for chip retention. The resulting barbed spear effectively retains the chip with very shallow penetration, which may be only slightly more than the thickness of the paper. This enables easy removal of the impaled chip in that only the trailing edge of the chip needs to be lifted from the cylinder.

Spears embodying the invention may be readily manufactured by cutting or shearing across a cutting rule having an edge at the end of an outside face, giving pieces that have a suitable single beveled edge. Formation of barbs in the manufacturing process is not required inasmuch as contact of the edge with an opposing roller quickly produces a barb ideally suited for chip retention. Spears may be mounted on opposing rollers as required for a particular arrangement of knives and rollers.

It is, therefore, an object of this invention to provide a chip-impalement spear for a rotary cutter that will effectively retain an impaled chip for being conveyed away from the cutting area of the cutter.

Another object is to provide such a spear having an impalement edge suitable for formation of a one-sided, chip-retaining barb upon contacting an opposing roller of rotary cutter.

Still another object is to provide chip-impalement spears that effectively retain chips for removal with only a very shallow depth of penetration.

Yet another object is to provide a simple method of making chip-impalement spears.

Other objects and advantages of the invention will be apparent from the following detailed description of appended claims.

BRIEF DESCRIPTION OF THE DRAWINGS

FIG. 1 is a front elevational view of a chip-impalement spear embodying the invention.

FIG. 2 is a side elevational view of the spear shown in FIG. 1.

FIG. 4 is a side elevational view showing a spear with a chip-retaining barb formed on its edge.

FIG. 5 is a perspective view showing a roller and block for mounting of chip-impaling spears.

DESCRIPTION OF THE PREFERRED EMBODIMENT

Figure 3:
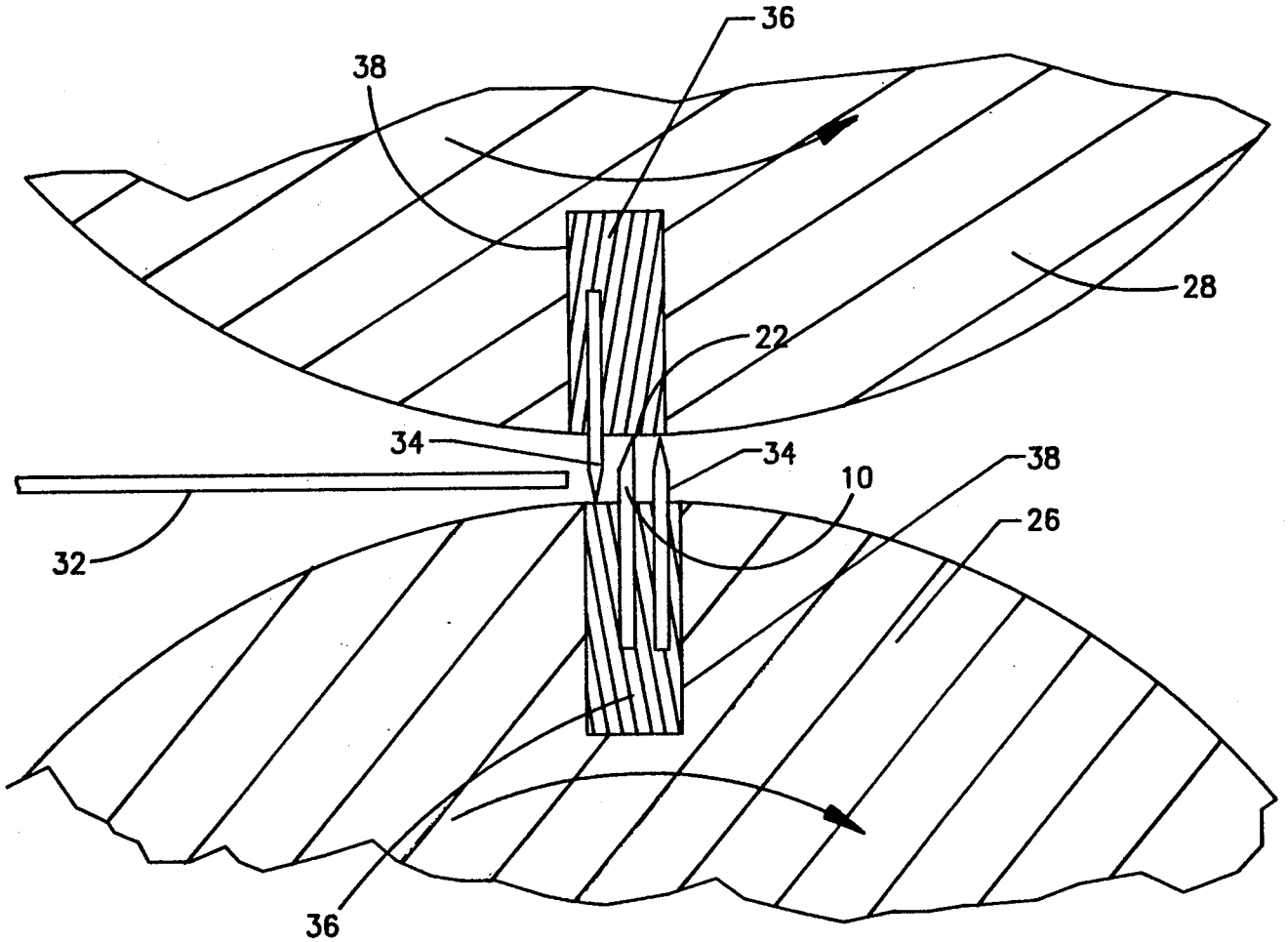
FIG. 3 is an end view, taken in section, showing placement of a spear in relation to opposing rollers and cutting knives.

Referring to FIGS. 1 and 2, there is shown an impalement spear 10 in the form of a generally rectangular bar-like object having relatively wide front and rear faces 12, 14 and narrow sides 16, 18. The top 20 of the spear is inclined diagonally downward defining with the end of face 14 a sharp edge 22 extending the full width of the spear. The top may be inclined downward at an angle such as 45 degrees. Inner or bottom end 24 may be fixedly mounted in a roller as shown in FIG. 5 and placed to protrude outward a distance such as to make effective contact with an opposing roller. For example, where the cooperating rollers are spaced with their surfaces 0.035 inch apart, the spears would preferably be placed to protrude outward 0.040 inch from the surface of the roller in which it is mounted so that 0.005 inch of the spear tip would come into contact with the opposing roller surface.

FIG. 3 shows a spear 10 installed in anvil roller 26 arranged parallel and spaced apart from knife roller 28. As shown by the arrows, the rollers rotate in opposite directions, and anvil roller 26 conveys impaled chips downward and away from the cutting area. The spear is mounted with edge 22 parallel to the rollers and extending forward with respect to the direction of rotation. This brings the edge into contact with the opposing roller 28 and results in bending of the edge over in the direction of movement, forming a barb 30 (FIG. 4). As shown in FIG. 3, a web 32 of printed paper is continuously passed from other components of a web printing press (not shown) between the rollers where it is cut by the knives, and the chip produced between the knives is impaled by spear 10. Printed product units may be propelled outward by being grasped by nip rollers (not shown).

Impalement spears 10 as well as knives 34 may be mounted by being secured in a rectangular block 36 mated within a longitudinal slot 38 in the roller. The arrangement shown in FIG. 3 has one knife mounted in the upper roller and another knife along with impalement spears 10 mounted in the lower roller in position to impale chips produced by cutting of the web by the two knives, the spears impaling the chips as the cuts are being made. Other arrangements of knives and spears mounted on knife and anvil rollers or knife/anvil rollers may also be used.

An important feature of the invention is the provision of a spear having properties, in particular, a hardness value, such as to enable its edge to be bent over upon contacting an opposing roller to form a barb without damaging the roller or wearing it away excessively. A.I.S.I steel having a scleroscopic temper hardness of 35 to 85 may be used, with a hardness of 75 being preferred. A suitable material for making spears is contained in cutting rules available from J.F. Helmold, Inc., under the designation 2 pt. 75 SF 0.918. Such cutting rules have a length of 30 inches, a width of 15/16 inch, and a thickness of 0.028 inch. One side of the rule has an edge with a rectangular cross section, and the opposite side has a single, sharp, bevelled edge along its length. When cut or sheared transversely at locations spaced apart 1/16 inch from one another, spear blanks of ideal dimensions may be produced. These dimensions, however, are not critical and may be varied depending on the particular rotary cutter apparatus. In general, the spears may have a length of ¼ to 2 inches, a width of 1/32 to ½ inch, and a thickness of 1/64 to ⅛ inch.

Preparation of the spears may be readily carried out by making transverse cuts across a cutting rule of the type described above by means of a horizontal rule cutter or bench shear.

While the invention is described above in terms of a specific embodiment, it is not to be understood as limited thereby, but is limited only as indicated by the following claims.

We claim:

1. A chip-impalement spear for a rotary cutter having a pair of opposing rollers comprising:

a metal body adapted to have one end thereof secured within the surface of a roller, the opposite end having a generally rectangular cross section with a single bevelled, straight, sharp edge along the opposite end and adapted to be placed with the said edge parallel to the roller and positioned so that the edge will come into slight contact with an opposing roller; and said metal body being elastically deformable such that said edge elastically deforms into a barb upon making contact with said opposing roller.

2. A chip-impalement spear as defined in claim 1 wherein said metal body has a scleroscopic temper hardness of 35 to 85.

3. A chip-impalement spear as defined in claim 2 wherein said metal body has an overall rectangular cross section.

4. A chip-impalement spear as defined in claim 2 wherein said metal body is made of A.I.S.I. 1065 steel.

5. A chip-impalement spear as defined in claim 3 wherein said metal body has a width of 1/32 to ½ inch and a thickness of 1/64 to ⅛ inch.

6. A chip-impalement spear as defined in claim 5 wherein said edge is bevelled at an angle of 30° to 75°.

7. In combination, a rotary cutter including at least one pair of cooperating rollers having mounted thereon a plurality of protruding knives arranged to make transverse cuts across a web of material being fed through in a manner such as to produce chips of said material;

a plurality of generally rectangular spears embedded in at least one of said rollers and arranged to impale said chips upon making said cuts; and said spears having a single sharp bevelled edge at their protruding ends parallel to said knives and being placed so that said edge will come into slight contact with an opposing roller upon rotation of said rollers, such that said edge elastically deforms into a chip-retaining barb at the protruding end of the spears.

8. The combination as defined in claim 7 wherein said spears are located so that 0.005 inch of the sharp-edged ends of said spears will come into contact with an opposing roller.

9. The combination as defined in claim 7 wherein each said spear is mounted with said edge disposed forward with respect to the direction of the roller in which the spear is embedded.

* * * * *